US006232704B1

(12) United States Patent
Herweg et al.

(10) Patent No.: US 6,232,704 B1
(45) Date of Patent: May 15, 2001

(54) SPARK PLUG WITH SPECIFIC ELECTRODE STRUCTURE

(75) Inventors: Ruediger Herweg, Esslingen; Rudolf Maly, Sindelfingen, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/294,311

(22) Filed: Apr. 20, 1999

(30) Foreign Application Priority Data

Apr. 20, 1998 (DE) ..... 198 17 391

(51) Int. Cl.[7] ..... H01T 13/20
(52) U.S. Cl. ..... 313/141; 313/144
(58) Field of Search ..... 313/141, 136, 313/142, 144

(56) References Cited

U.S. PATENT DOCUMENTS 2,159,791 5/1939 Fruth .
4,514,657 4/1985 Igashira et al. .

FOREIGN PATENT DOCUMENTS

3132814A1 4/1982 (DE) .
4128392A1 3/1993 (DE) .
4128392C2 3/1993 (DE) .
0164613A1 12/1985 (EP) .
0287080A1 10/1988 (EP) .
0699870A1 3/1996 (EP) .
8-222351 8/1996 (JP) .

OTHER PUBLICATIONS

Patent Abstracts of Japan, vol. 013, No. 350, Aug. 7, 1989 &JP 01 109675A, Apr. 26, 1989.

*Primary Examiner*—Vip Patel
(74) *Attorney, Agent, or Firm*—Evenson, McKeown, Edwards & Lenahan, P.L.L.C.

(57) ABSTRACT

A spark plug for an internal combustion engine or a sensor element for an ignition or combustion process is provided in which at least one of the electrodes consists of two materials. The electrodes are designed such that the distance from a first area of one electrode to the other electrode is less than the distance from the one additional area of one electrode to the other electrode. The two areas consist of different materials, and at least one of the electrodes has a slight radius of curvature in the first area at the point at which the distance from the other electrode is minimal. Regardless of or in connection with this design, the shape of the surface of the electrode can be constant or continuous, at least at the transition between the two areas. One of the electrodes may have a material projection at a point that is opposite a point on the other electrode at which deposits can develop on the other electrode during operation.

27 Claims, 3 Drawing Sheets

SPARK PLUG WITH SPECIFIC ELECTRODE STRUCTURE

BACKGROUND AND SUMMARY OF THE INVENTION

This application claims the priority of German application 198 17 391.1, filed in Germany on Apr. 20, 1998, the disclosure of which is expressly incorporated by reference herein.

The present invention relates to a spark plug for an internal combustion engine and/or a sensor element for an ignition and combustion process in which at least one of the electrodes consists of two materials, with the electrodes being so designed that the distance from a first area of one of the electrodes to the other electrode is less than the distance from an additional area of the one of the electrodes to the other electrode, with the two areas consisting of different materials.

The structure of conventional spark plugs, used for example in transistor-coil ignition systems, is generally known. A high voltage on the order of 30 kV is produced at the electrodes of a spark plug and leads to a sparkover between the electrodes of the plug. The mixture in the combustion chamber of the engine is ignited by this sparkover so that the combustion process begins. The sparkover followed by the arc causes material to be removed from the electrodes (burn-off). Consequently, the electrode gap gradually increases so that as a result of this increase in the size of the gap, the voltage increases that is required to produce the sparkover. It is likewise known to use such spark plugs as ion current sensors for measuring and/or checking the ignition as well as the combustion process (see European Patent Document No. EP 0 699 870 A1).

To avoid the problems associated with burn-off it is known (see German Patent Document No. DE 41 28 392 C2) to make the electrodes of a spark plug from several materials. A carrier material has another material added to it that forms a first area of the electrode. The carrier material forms a second area of the electrode. The distance between the two first areas of the electrodes is smaller than the distance between the second areas. The first area consists of a noble metal such as platinum for example or a noble metal alloy such as platinum-iridium for example. It is also indicated that the second area consists of a nickel alloy which is known of itself and is used in the electrodes of spark plugs. The intent is for sparkover to take place in the first area of the electrodes and for the sparkover to be transferred to the second area during the arc phase. Since the removal of material from the noble metals is extremely small, in the course of a very long lifetime of the spark plug the distance between the first areas at which the sparkover takes place remains almost constant so that the voltage required to produce a sparkover is constant over a longer service life of the spark plug. The primary removal of material during the arc phase takes place in the second area.

Accordingly, a goal of the invention is to propose an improved spark plug and/or an improved sensor element.

This goal is achieved according to the invention by providing a spark plug or sensor element of the above described general type wherein at least one of the electrodes has a small radius of curvature in the first area at the point where the distance from the other electrode is minimal.

This small radius of curvature can be a point for example, corresponding to an idealized radius of curvature of zero. It is important in this connection that the shape of the surface strengthens the electrical field which can be described as essentially inversely proportional to the radius of curvature, so that sparkover is promoted. This is the case for a point for example or for a suitably curved surface. From the prior art it is only known in this connection to make the surfaces flat, in other words with an infinite radius of curvature.

It has been found that as a result of the slight removal of material from the first area, the geometric shape of the first area likewise remains almost unchanged so that the small radius of curvature and/or the point also is retained over a long service life without being worn away. As a result, because of the electrical field that forms as a function of the radius of curvature of the electrodes, the voltage required for sparkover can be reduced. This permits a simplification of the design of spark plugs because the insulating materials such as ceramic boiler scale or plastic insulation are at the limit of their performance at the voltages previously required for sparkover (on the order of 30 kV). Increasing the wall thicknesses of the insulating materials to improve the insulation is not readily possible because it can cause uncontrolled surface and volume discharges that destroy the materials.

In another solution according to the invention, a spark plug or sensor of the above described general type is provided, wherein the shape of the electrode is continuous at least at the transition between the two areas.

As a result, the transfer of the spark following sparkover in the arc phase from the first area to the second area is facilitated by contrast with an arrangement in which there is a discontinuity at the transition from the first to the second area.

An especially advantageous improvement to known spark plugs is achieved according to especially preferred embodiments by providing a spark plug or sensor of the above described general type, wherein both of the features referred to above are included, namely, wherein at least one of the electrodes has a small radius of curvature in the first area at the point where the distance from the other electrode is minimal, and wherein the shape of the surface of the electrode is continuous, at least in the transition between the two areas.

It has been found to be advantageous if, according to certain especially preferred embodiments, at least one of the two areas is composed of several materials.

In the design of a spark plug according to certain preferred embodiments of the invention, as a result of the geometric shape of the two areas, for example thickenings, narrowings, threads, or grooves, the electrode is prevented from falling apart at the point where the two areas join, even under alternating mechanical and thermal stress.

In the design of a spark plug according to certain preferred embodiments of the invention, the nature of the connection between the two areas, for example welding, soldering, or shrinking, the electrode is prevented from falling apart at the point where the two areas join, even under alternating mechanical and thermal stress.

As a result, problems are avoided that can occur for example as a result of different thermal conducting properties of the materials or of erosion of the carrier materials.

Certain preferred embodiments of the invention provide for an improvement of the preferable embodiment of the spark plugs described above and include a feature by which improvements can be achieved in the spark plugs known from the prior art. Accordingly, at least one of the electrodes has a material projection at a point that is opposite a point on the other electrode at which material losses can occur at the other electrode during operation.

As a result of this design, an auxiliary spark gap is advantageously produced at which material deposits are eliminated by occasional surface discharges. The spark plug is therefore not prone to sooting.

Of course, it is advantageous if not just one of the electrodes is designed in this way but if both electrodes are designed according to the embodiments described and claimed.

Even though the conditions, for the sake of understanding and clarity of presentation, both in conjunction with the claims and also in the description of the figures, are explained only with reference to the spark plug, it is evident from the relationship and especially the claims that the spark plug can also be used as a sensor element and that the part described as a spark plug can be used simply as a sensor element without the combustion process being triggered by the part.

Other objects, advantages and novel features of the present invention will become apparent from the following detailed description of the invention when considered in conjunction with the accompanying drawings.

BRIEF DESCRIPTION OF THE DRAWINGS

FIG. 3A is a schematic view of alternative shape electrode tips for the embodiment of FIG. 3;

FIG. 4A is a schematic view of alternative shape electrode tips for the embodiment of FIG. 4;

DETAILED DESCRIPTION OF THE DRAWINGS

Figure 2:
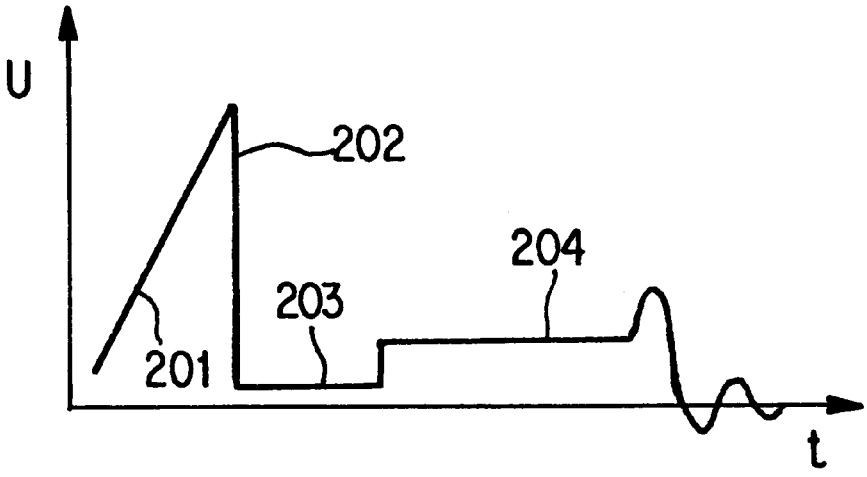
FIG. 2 is a graph of the curve of the voltage vs. time in a conventional transistor-coil ignition system, provided to explain certain features of preferred embodiments of the present invention.

FIG. 2 shows the curve of voltage vs. time for a conventional transistor-coil ignition system. The spark phase 201 is the rising slope typically lasting 60 $\mu$s. Spark phase 202 is the breakdown phase typically lasting 2 ns, with an energy of about 0.5 mJ and a spark erosion of approximately $12*10^{-12}$ g/mJ. Spark phase 203 is the arc phase lasting approximately 1 ms, with an energy of approximately 1 mJ and a spark erosion of approximately $210*10^{-12}$ g/mJ. Spark phase 204 is the glow phase lasting approximately 2 ms with an energy of approximately 60 mJ and a spark erosion of approximately $3*10^{-12}$ g/mJ.

In conventional transistor-coil ignition systems, it is the glow phase that is primarily responsible for ignition, with the ignition reliability increasing with the level of the peak current and the discharge time. A maximum ignition energy is always provided that is far higher than required for most working points, since participatory energy regulation is not possible in transistor-coil ignition systems. On the basis of the design of the coil and the capacities of the ignition cables, a portion of the arc necessarily develops that has low energy but is dominant as far as the shortening of the spark plug life by erosion is concerned. In spark plugs, a reliable technology using mostly ground electrodes that are bent has become established in terms of ceramic and design. Chromium-nickel alloys cooled by a copper core are used as materials for solid electrodes, and in special cases silver or platinum. Because of the usual separation of the coil and the spark plug, long ignition cables are sometimes required which significantly determine the arc portions, especially in follow-up ignition. The lifetime of a spark plug is generally limited by an inadmissibly high rise in the voltage on the electrodes that is required for sparkover (ignition voltage requirement) because of the burning-off of the electrodes and the resultant increase in the electrode gap. If the spark plugs are correctly dimensioned from the thermal standpoint, spark erosion dominates in the arc phase.

This is intended to be minimized in the present invention by directing the current flow to areas of the electrodes in which erosion is admissible. As a result, erosion can even lead to an increase in the effective electrode gap and consequently to more stable idle behavior. As a result of this erosion, there is no increase in the ignition voltage requirement because this current flow becomes effective in the second area only after a spark discharge has already taken place in the first area and a transfer of the arc to the second area has occurred.

Figure 1:
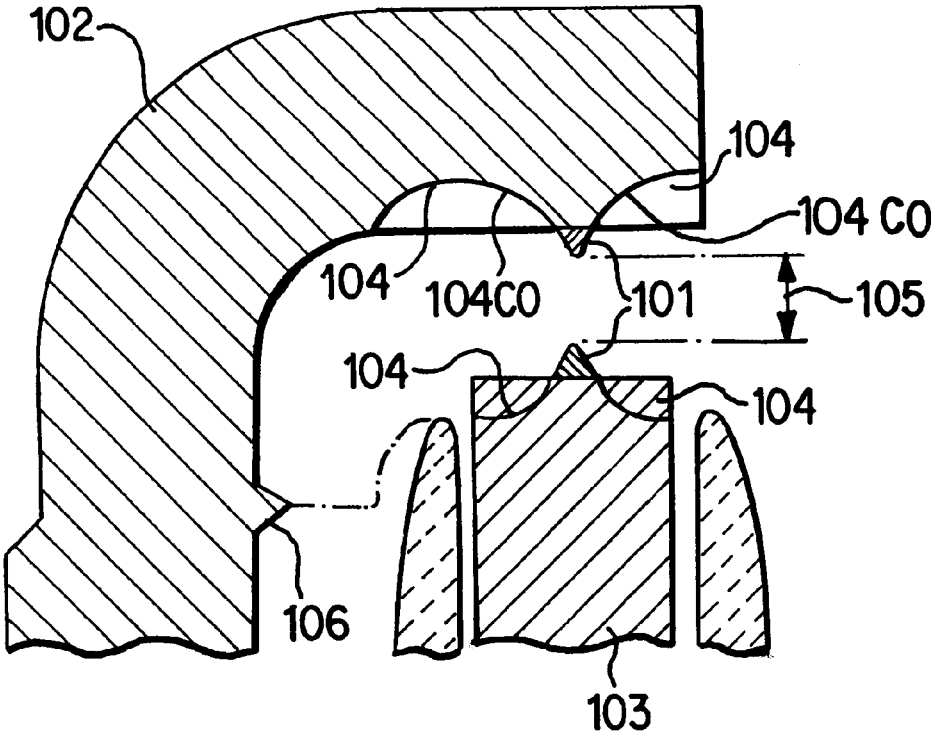
FIG. 1 is a schematic sectional side view which shows spark plug electrodes designed as compound electrodes, according to a preferred embodiment of the invention.

FIG. 1 shows the current being directed by using a compound electrode. Anchor points are provided in first area 101. These anchor points are made of a material with a high work function for electrons and/or a high evaporation temperature and/or a high specific resistance and/or a low electron yield under plasma conditions.

Such materials for example can be noble metals such as platinum, alloys of noble metals, or the like.

For example, platinum can be replaced by other metals in the platinum group such as rhenium, palladium, or iridium.

It is also contemplated according to certain preferred embodiments to replace the metals in the platinum group by high-temperature semiconductors such as:

carbides of B, Al, Mg, Ti, V, Cr, Mn, Fe, Co, Ni, Ta, Mo, and W;

nitrites of B, Al, Mg, Ti, V, Cr, Mn, Fe, Co, Ni, Ta, Mo, and W;

oxides of B, Al, Mg, Ti, V, Cr, Mn, Fe, Co, Ni, Ta, Mo, and W; and borides of Ti, V, Cr, Mn, Fe, Co, Ni, Ta, Mo, and W.

Instead of using pieces of such materials, implantation of the corresponding materials can also be performed according to certain preferred embodiments of the invention. It is also contemplated, instead of using suitable pieces of material, to produce local coatings of these materials or semiconducting carbon compounds. The carbon compounds can also be combined with the materials listed above.

The anchor points that form first area 101 are located on both electrodes 102,103 on materials with inverse properties (for example CrNi compounds). When these materials form the surfaces of electrodes 102,103, they form second area 104. The material of this second area 104 may be subject to burn-off erosion. It is therefore important to ensure that the transition from the first area 101 to the second area 104 is constant or continuous, favoring the control of the spark current.

The anchor points forming the first area 101 determine the ignition voltage and the ignition location. The choice of materials given makes it necessary for the first sparkover to take place at the anchor points that form the first area, but the discharge immediately changes to the second areas 104 of carrier electrodes 102,103 designed as sacrificial areas. As a result of the choice of the materials and the geometric arrangement thereof, the spark current is moved past the anchor points to the sacrificial areas following sparkover, so that the ignition voltage requirement of the spark plug remains nearly constant during its lifetime.

As a result, the burn-off in the first area 101 formed by the anchor points is minimal, so that the electrode gap 105 that determines the ignition voltage requirement remains almost constant. The burn-off is transferred to the second area 104 of carrier electrodes 102,103 defined above. The effective spark length following sparkover increases with time (increasing burn-off) thus even favoring the ignition ability of the ignition system.

The drawing in FIG. 1 indicates that burn-off takes place in second area 104 in such fashion that material is removed, forming the concave surface 104CO.

It is also evident that the anchor points forming the first area 101 have a small radius of curvature at the point where electrode gap 105 is smallest. As a result, the ignition voltage requirement is further reduced.

In addition, there is a material projection 106 on electrode 102 that is located opposite a point on the other electrode 103 at which material can be removed from the other electrode 103 during operation. As a result, an auxiliary spark area results by means of which deposits can be eliminated by occasional surface discharges. This measure in the auxiliary spark area can also be used in other spark plugs independently of the design of the spark plug described above.

It has been found in that the lifetime of a spark plug can be more than tripled by these measures.

Figure 3:
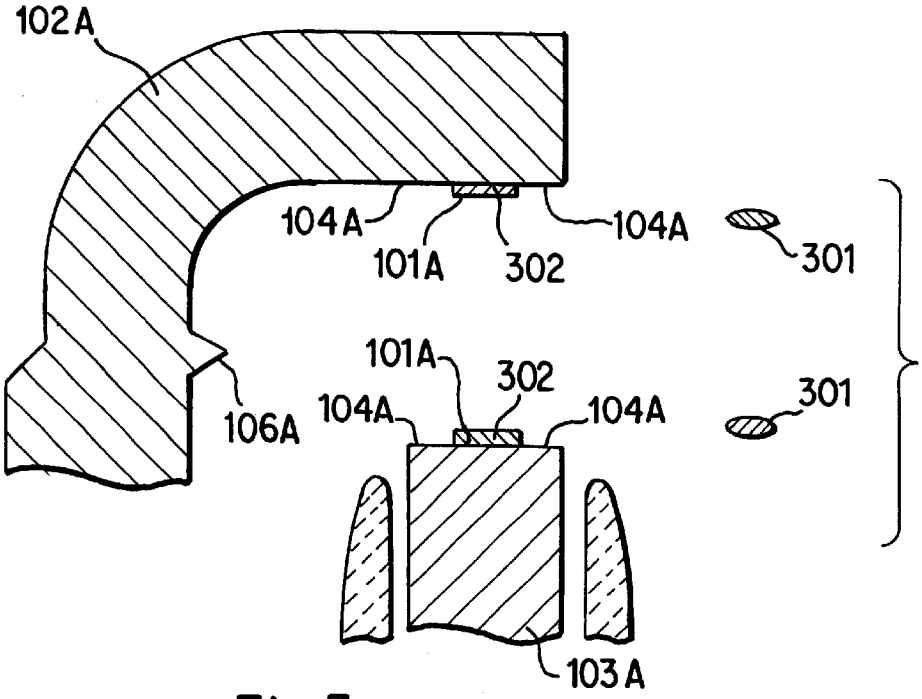
FIG. 3 is a schematic sectional side view which shows spark plug electrodes designed as compound electrodes according to a second preferred embodiment of the invention.

FIG. 3 shows another embodiment of the electrodes of a spark plug in which the areas 101A formed by the anchor points can be small pieces or flakes 302 of the corresponding materials or even spherules 301 (FIG. 3A). The other features of FIG. 3 correspond to similarly numbered features (with suffix A) of FIG. 1 and the above description of FIG. 1 applies.

Figure 4:
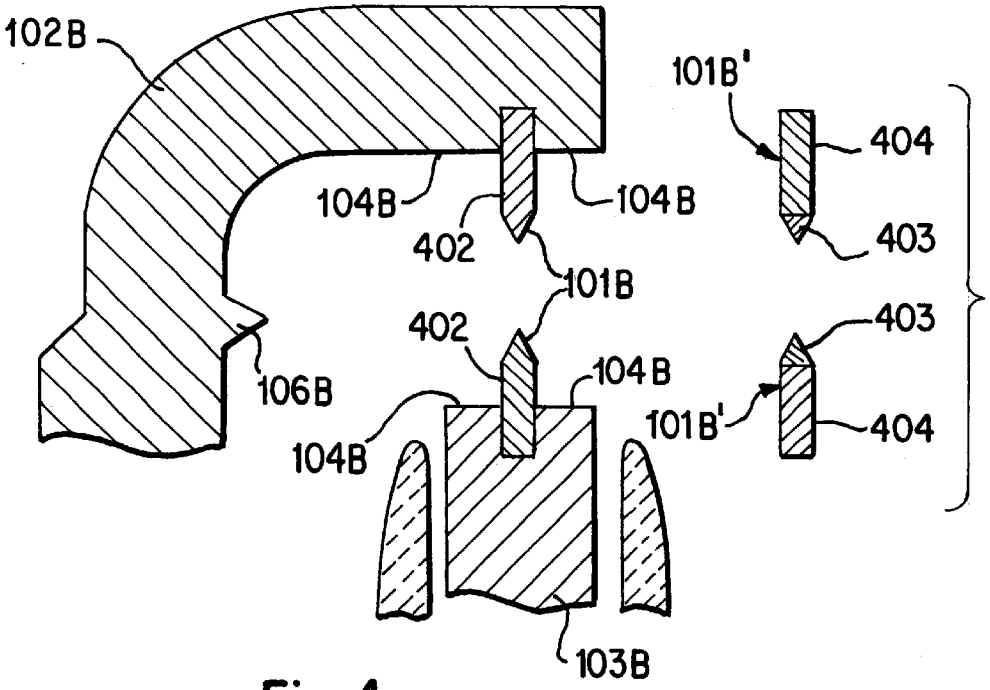
FIG. 4 is a schematic sectional side view which shows spark plug electrodes designed as compound electrodes according to a third preferred embodiment of the invention.

On the other hand, FIG. 4 shows that the first area 101B can also be formed by pins 401, 402. In the FIG. 4A arrangement, pins 404 at tip 403 consist of a material that is different from the body 404 of the pins (electrodes 101B'). By choosing the corresponding materials for their resistance ratio, the deflection of the spark current to the second area 104B can be favored. The other features of FIG. 4 correspond to similarly numbered features (with suffix B) of FIG. 1 and the above description of FIG. 1 applies.

Figure 6:
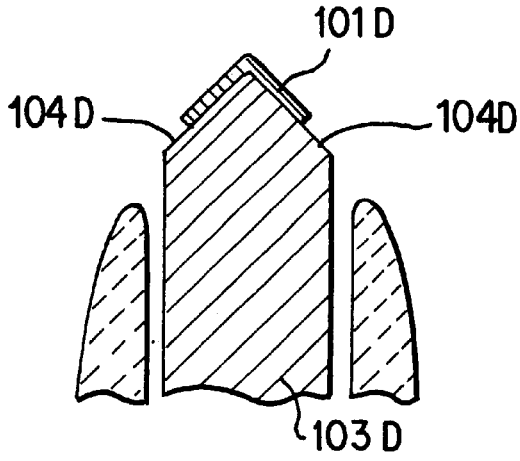
FIG. 6 is a schematic sectional side view of one electrode constructed according to a fifth embodiment of the invention.

In the electrode according to FIG. 6, the first area 101D is formed by a coating of the corresponding material. The other features of FIG. 6 correspond to similarly numbered features (with suffix D) of FIG. 1 and the above description of FIG. 1 applies.

Figure 5:
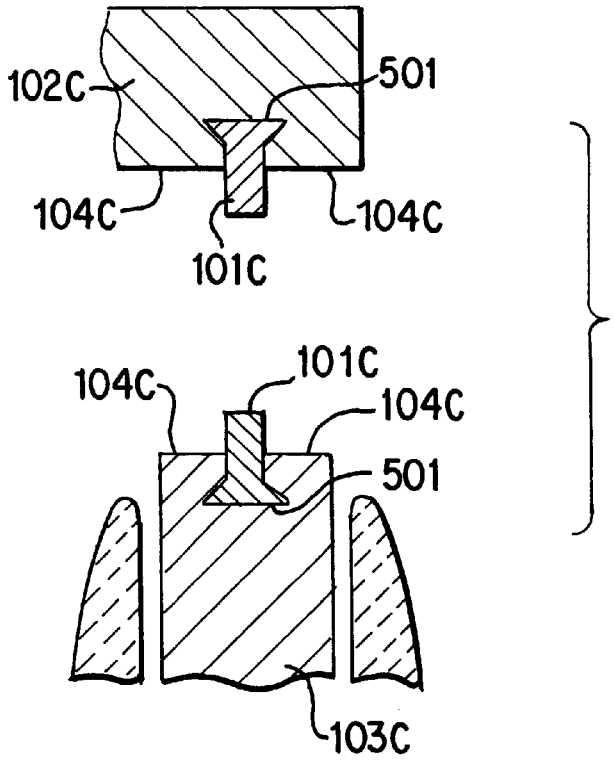
FIG. 5 is a schematic sectional side view which shows spark plug electrodes designed as compound electrodes according to a fourth preferred embodiment of the invention.

FIG. 5 shows a design of the first area 101C in which the latter has a foot 501. By means of this foot, the material of the first area is held in carrier electrode 102C, 103C even when burn-off has already occurred in second area 104C. This is very important since when parts of the spark plug come off, the engine may be destroyed. The other features of FIG. 5 correspond to similarly numbered features (with suffix C) of FIG. 1 and the above description of FIG. 1 applies.

As a result of the above described designs according to preferred embodiments of the invention, field distortions can be produced by which current control can be supported. For example, the first area can consist of a semiconductor that is a poor conductor. The low ignition current does not produce any significant voltage drop in the semiconductor, or the semiconducting layer whose resistance can be between 10 and 1000 ohms for example. However, if the spark current rises above a limiting value, the voltage drop becomes so great that the spark discharge is displaced to the second area. By choosing the resistances, the shape, and the local positioning, very large gaps can be forced. Combination layers can also be used. Large spark gaps improve the ignition ability of the mixture.

It is also contemplated to control the current by the resistances in the first area. For example, by using a combination of metals and semiconductors, the required conductivity and erosion resistance can be optimized.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Spark plug for an internal combustion engine in which at least one of the electrodes consists of two materials, with the electrodes being so designed that the distance from a first area of one of the electrodes to the other electrode is less than the distance from an additional area of the one of the electrodes to the other electrode, with the two areas consisting of different materials, wherein at least one of the electrodes has a small radius of curvature in the first area at a point at which the distance from the other electrode is minimal.

2. Spark plug according to claim 1, wherein the shape of the surface of at least one of the electrodes is continuous at least at a transition between the two areas.

3. Spark plug according to claim 1, wherein at least one of the two areas consists of several materials.

4. Spark plug according to claim 2, wherein at least one of the two areas consists of several materials.

5. Spark plug according to claim 1, wherein as a result of a geometric design of the two areas, for example thickenings, interlacings, threads, or grooves, the respective electrode is prevented from falling apart at the connection between the two areas even under alternating mechanical and thermal stress.

6. Spark plug according to claim 2, wherein as a result of a geometric design of the two areas, for example thickenings, interlacings, threads, or grooves, the respective electrode is prevented from falling apart at the connection between the two areas even under alternating mechanical and thermal stress.

7. Spark plug according to claim 3, wherein as a result of a geometric design of the two areas, for example thickenings, interlacings, threads, or grooves, the respective electrode is prevented from falling apart at the connection between the two areas even under alternating mechanical and thermal stress.

8. Spark plug according to claim 1, wherein, as a result of the nature of the connection between the two areas, for example welding, soldering, or shrinking, the electrodes are prevented from falling apart at the connection between the two areas even under alternating mechanical and thermal stress.

9. Spark plug according to claim 2, wherein, as a result of the nature of the connection between the two areas, for example welding, soldering, or shrinking, the electrodes are prevented from falling apart at the connection between the two areas even under alternating mechanical and thermal stress.

10. Spark plug according to claim 3, wherein, as a result of the nature of the connection between the two areas, for example welding, soldering, or shrinking, the electrodes are prevented from falling apart at the connection between the two areas even under alternating mechanical and thermal stress.

11. Spark plug according to claim 5, wherein, as a result of the nature of the connection between the two areas, for example welding, soldering, or shrinking, the electrodes are prevented from falling apart at the connection between the two areas even under alternating mechanical and thermal stress.

12. Spark plug according to claim 1, wherein at least one of the electrodes has a material projection that is opposite a point on the other electrode at which deposits can develop on the other electrode during operation.

13. Spark plug according to claim 2, wherein at least one of the electrodes has a material projection that is opposite a point on the other electrode at which deposits can develop on the other electrode during operation.

14. Spark plug according to claim 3, wherein at least one of the electrodes has a material projection that is opposite a point on the other electrode at which deposits can develop on the other electrode during operation.

15. Spark plug according to claim 5, wherein at least one of the electrodes has a material projection that is opposite a point on the other electrode at which deposits can develop on the other electrode during operation.

16. Spark plug according to claim 8, wherein at least one of the electrodes has a material projection that is opposite a point on the other electrode at which deposits can develop on the other electrode during operation.

17. Spark plug for an engine in which at least one of the electrodes consists of two materials, with the electrodes being so designed that the distance from a first area of one electrode to the other electrode is shorter than the distance from an additional area of the electrodes to the other electrode with the two areas consisting of different materials, wherein the shape of the surface of at least one of the electrodes is continuous at least at the transition between the two areas.

18. Spark plug according to claim 17, wherein at least one of the two areas consists of several materials.

19. Spark plug according to claim 17, wherein as a result of a geometric design of the two areas, for example thickenings, interlacings, threads, or grooves, the respective electrode is prevented from falling apart at the connection between the two areas even under alternating mechanical and thermal stress.

20. Spark plug according to claim 17, wherein, as a result of the nature of the connection between the two areas, for example welding, soldering, or shrinking, the electrodes are prevented from falling apart at the connection between the two areas even under alternating mechanical and thermal stress.

21. Spark plug according to claim 17, wherein at least one of the electrodes has a material projection that is opposite a point on the other electrode at which deposits can develop on the other electrode during operation.

22. Spark plug for an internal combustion engine comprising:

a first electrode, and a second electrode spaced from the first electrode to form a gap therebetween, wherein at least one of the electrodes includes a first area formed of a first material and a second area formed of a second material, wherein said first area is closer to the other of said first and second electrodes than said second area, wherein the first area has a small radius of curvature at a point closest to the other electrodes, and wherein said first material is less subject to erosion than said second material during operations of the spark plug, whereby said second area is permissibly eroded by current flow directed thereto by the configuration of the first and second areas.

23. Spark plug according to claim 22, wherein both of the electrodes have similar first and second areas facing one another.

24. Spark plug according to claim 22, wherein said first and second areas merge continuously with one another.

25. Spark plug according to claim 24, wherein both of the electrodes have similar first and second areas facing one another.

26. Spark plug for an internal combustion engine comprising:

a first electrode, and a second electrode spaced from the first electrode to form a gap therebetween, wherein at least one of the electrodes includes a first area formed of a first material and a second area formed of a second material, wherein said first area is closer to the other of said first and second electrodes than said second area, and wherein said first and second areas merge continuously with one another.

27. Spark plug according to claim 26, wherein both of the electrodes have similar first and second areas facing one another.

* * * * *